US010310423B2

(12) United States Patent
Chen et al.

(10) Patent No.: US 10,310,423 B2
(45) Date of Patent: Jun. 4, 2019

(54) HEATING ROLLER HAVING THREE HEATERS OF THREE DIFFERENT HEATING SECTIONS AND IMAGE FORMING APPARATUS USING SUCH HEATING ROLLER

(71) Applicant: AVISION INC., Hsinchu (TW)

(72) Inventors: Yen-Cheng Chen, Baoshan Township (TW); Ming Chung Li, Zhudong Township (TW)

(73) Assignee: Avision Inc. (TW)

( * ) Notice: Subject to any disclaimer, the term of this patent is extended or adjusted under 35 U.S.C. 154(b) by 0 days.

(21) Appl. No.: 16/004,160

(22) Filed: Jun. 8, 2018

(65) Prior Publication Data

US 2019/0011859 A1 Jan. 10, 2019

(30) Foreign Application Priority Data

Jul. 7, 2017 (TW) ..... 106122786 A

(51) Int. Cl.
*G03G 15/20* (2006.01)

(52) U.S. Cl.
CPC ..... *G03G 15/205* (2013.01); *G03G 15/2042* (2013.01); *G03G 15/2053* (2013.01)

(58) Field of Classification Search
CPC ..... G03G 15/205; G03G 15/2053; G03G 15/2042; G03G 15/2007; G03G 15/5029; G03G 2215/2006
See application file for complete search history.

(56) References Cited

U.S. PATENT DOCUMENTS

| | | | | |
|---|---|---|---|---|
| 7,459,658 | B2 | 12/2008 | Hays et al. | |
| 2007/0045295 | A1 | 3/2007 | Hays | |
| 2007/0059004 | A1 | 3/2007 | Kang | |
| 2009/0190343 | A1* | 7/2009 | Shimonaka | G03G 15/2053 362/217.01 |
| 2013/0108300 | A1* | 5/2013 | Fujii | G03G 15/2042 399/69 |
| 2013/0142533 | A1* | 6/2013 | Shimizu | G03G 15/2042 399/67 |
| 2013/0209147 | A1* | 8/2013 | Ogawa | G03G 15/205 399/329 |
| 2016/0306305 | A1 | 10/2016 | Yamada | |
| 2017/0168433 | A1* | 6/2017 | Okamoto | G03G 15/2042 |

FOREIGN PATENT DOCUMENTS

| | | | |
|---|---|---|---|
| CN | 106054565 A | | 10/2016 |
| JP | 2010271392 A | * | 12/2010 |
| TW | 200714121 A | | 4/2007 |

OTHER PUBLICATIONS

Machine translation of JP 2010-271392 A, publication date of Dec. 2, 2010, printed on Nov. 5, 2018.*

* cited by examiner

*Primary Examiner* — Sophia S Chen

(57) ABSTRACT

A heating roller includes: a roller cylinder rotatably disposed; a base rotatably disposed in the roller cylinder; first to third heaters, which are mounted on the base and respectively have a first heating section, a second heating section and a third heating section extending respectively in directions substantially parallel to an axial direction of the roller cylinder; and a driving mechanism, which is connected to the base and rotates the base to multiple position states. An image forming apparatus using the heating roller is also disclosed.

16 Claims, 6 Drawing Sheets

HEATING ROLLER HAVING THREE HEATERS OF THREE DIFFERENT HEATING SECTIONS AND IMAGE FORMING APPARATUS USING SUCH HEATING ROLLER

CROSS-REFERENCE TO RELATED APPLICATIONS

This application claims priority of No. 106122786 filed in Taiwan R.O.C. on Jul. 7, 2017 under 35 USC 119, the entire content of which is hereby incorporated by reference.

BACKGROUND OF THE INVENTION

Field of the Invention

This disclosure relates to a heating roller and an image forming apparatus using the same, and more particularly to a heating roller having three heaters of three different heating sections and an image forming apparatus using the same.

Description of the Related Art

A conventional heating roller only has a single heater, and a length of the heater is approximately equal to an axial length of the heating roller. When the maximum copy area of the copier is designed to be equal to the A3 size, the heater over the entire axial length of the heating roller needs to be used. If the original has the A4 size, then only the heater in the axial middle portion of the heating roller is used to fix the A4 size sheet. This wastes the heat generated in the axial areas on two sides of the heating roller, thereby wasting electrical energy or easily consuming the heating roller. In addition, because the heat in the axial areas on two sides of the heating roller is not taken away by sheets, the temperature thereon easily gets too high, so that the thermometer inside the heating roller senses the high temperature to turn off the power, and the copier enters a pause state.

Therefore, how to provide a heating roller capable of avoiding the energy waste and too-high temperature is a problem to be solved by this disclosure.

BRIEF SUMMARY OF THE INVENTION

An objective of this disclosure is to provide a heating roller and an image forming apparatus using the same to avoid the energy waste and too-high temperature, wherein the heating roller is applicable to various sizes of print sheets.

To achieve the above-identified object, this disclosure provides a heating roller including: a roller cylinder rotatably disposed; a base rotatably disposed in the roller cylinder; first to third heaters, which are mounted on the base, and respectively have a first heating section, a second heating section and a third heating section extending in directions substantially parallel to an axial direction of the roller cylinder; and a driving mechanism, which is connected to the base and rotates the base to multiple position states. The first to third heating conditions different from one another are provided according to the position states in conjunction with power-on and power-off states of the first heating section, the second heating section and the third heating section.

In the above-mentioned aspect, the roller cylinder provides the first to third heating conditions to cooperate with a pressure roller to fix toner onto first to third sheets having different widths.

This disclosure further provides an image forming apparatus including: the above-mentioned heating roller and pressure roller; and a control processor, which receives a printing signal so that the toner is fixed onto one of the first to third sheets. The control processor controls the driving mechanism to rotate the base to the position states according to width information of the printing signal.

This disclosure further provides an image forming apparatus including: the above-mentioned heating roller and pressure roller; a width detector, which detects a width of one of the first to third sheets to obtain a width signal; and a control processor, which receives a printing signal and the width signal so that the toner is fixed onto one of the first to third sheets. The control processor controls the driving mechanism to rotate the base to the position states according to width information of the width signal.

With the above-mentioned heating roller and image forming apparatus using the same, the print or copy procedures of more than three different sizes of sheets can be easily implemented, too-high temperature of the heating roller can be effectively avoided, the stable operational effect can be achieved, the waste of the heating power can be further effectively avoided, and the energy saving requirements of environmental protection can be achieved.

Further scope of the applicability of this disclosure will become apparent from the detailed description given hereinafter. However, it should be understood that the detailed description and specific examples, while indicating preferred embodiments of this disclosure, are given by way of illustration only, since various changes and modifications within the spirit and scope of this disclosure will become apparent to those skilled in the art from this detailed description.

DETAILED DESCRIPTION OF THE INVENTION

Figure 1:
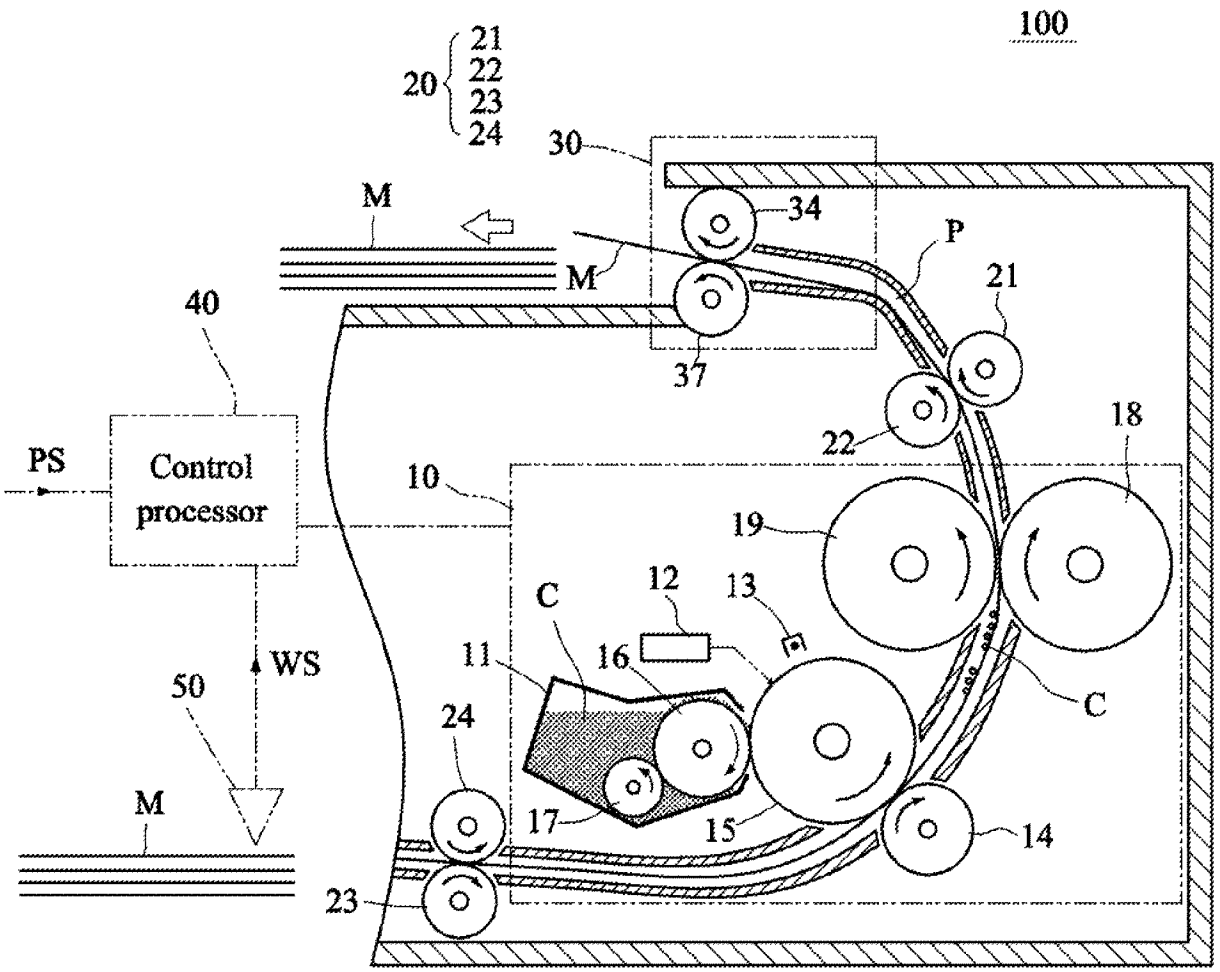
FIG. 1 is a schematic side view showing an image forming apparatus according to a first embodiment of this disclosure.

FIG. 1 is a schematic side view showing an image forming apparatus 100 according to a first embodiment of this disclosure. As shown in FIG. 1, the image forming apparatus 100, such as a printer, a copier or a multi-function peripheral, includes a printing module 10, a transporting mechanism 20 and a discharge mechanism 30.

Figure 4:
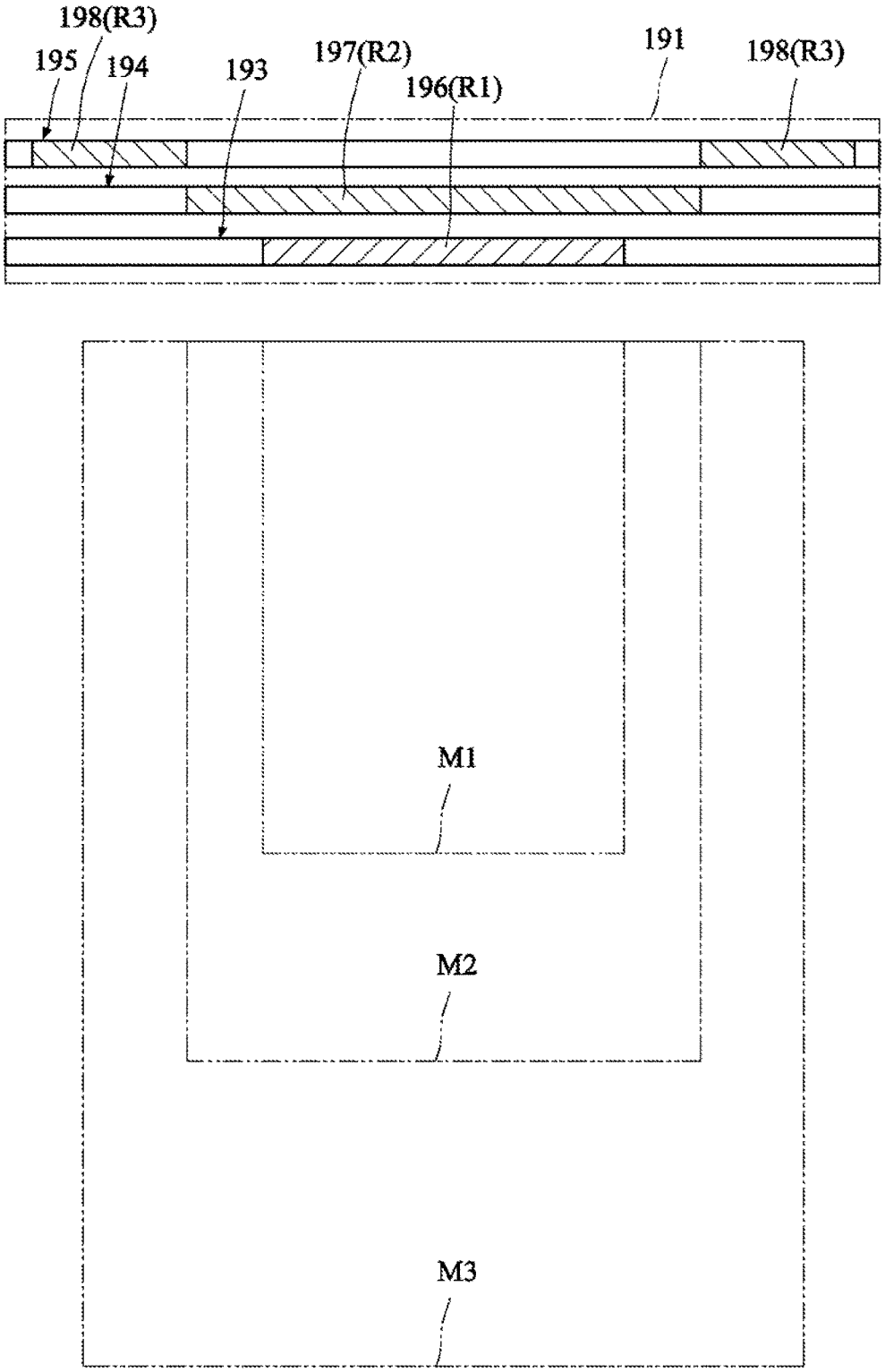
FIG. 4 is a schematic view showing sheets with different widths and the width direction of the heating roller of FIG. 1.

The printing module 10 sequentially prints data on multiple sheets M (it is represented by first to third sheets M1 to M3 in FIG. 4). The transporting mechanism 20 transports the sheets M past the printing module 10. In this embodiment, the transporting mechanism 20 includes transporting rollers 21, 22, 23 and 24. In this embodiment, the laser printing module used in a laser printer is taken as an example for illustration, but this disclosure is not restricted thereto.

In the printing module 10, a toner cartridge 11 accommodates toner C, and a supply roller 17 is rotatably disposed on the toner cartridge 11 to supply the toner C to a rotatable development roller 16. A charger 13 uniformly charges a rotatable drum 15, and a laser scanning unit 12 outputs a laser beam to form an electrostatic pattern on the drum 15. A transfer roller 14 and the drum 15 are rotatably disposed upstream of a heating roller 19 (the effect of the fixation is provided in this embodiment, so it is also known as the fixation roller), and nip the sheet M fed from the rollers 23 and 24 therebetween to transfer the electrostatic pattern of the drum 15 onto the sheet M. Then, the sheet M is processed by a pressure roller 18 and the heating roller 19 so that the toner C is fixed onto the sheet M. Then, the fixed sheet M enters a sheet passage P. The discharge mechanism 30 includes a first roller 34 and a second roller 37, which are located downstream of the transporting mechanism 20, and transport the sheets M to a discharge tray.

Figure 2:
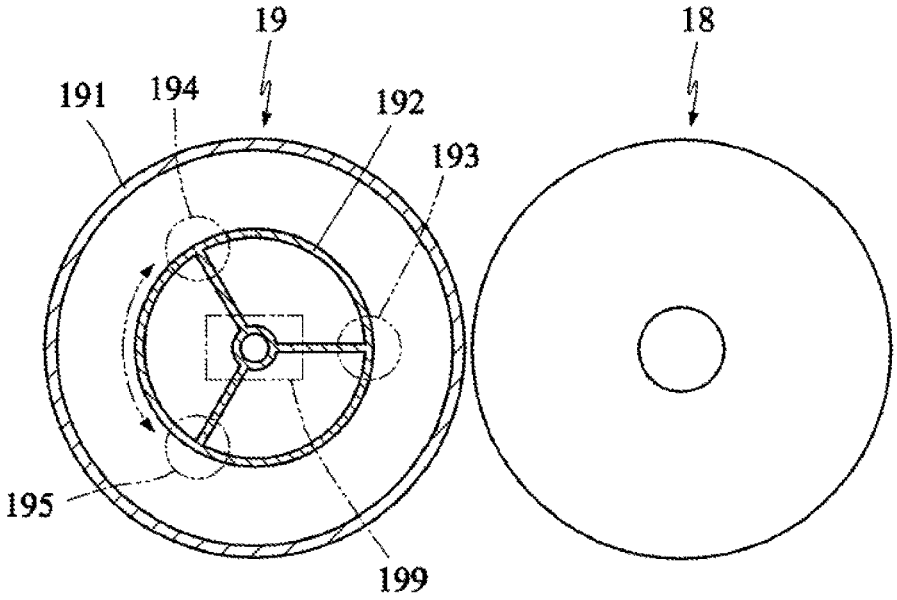
FIG. 2 is a schematic side view showing a heating roller and a pressure roller of FIG. 1 in a first position state.
Figure 3:
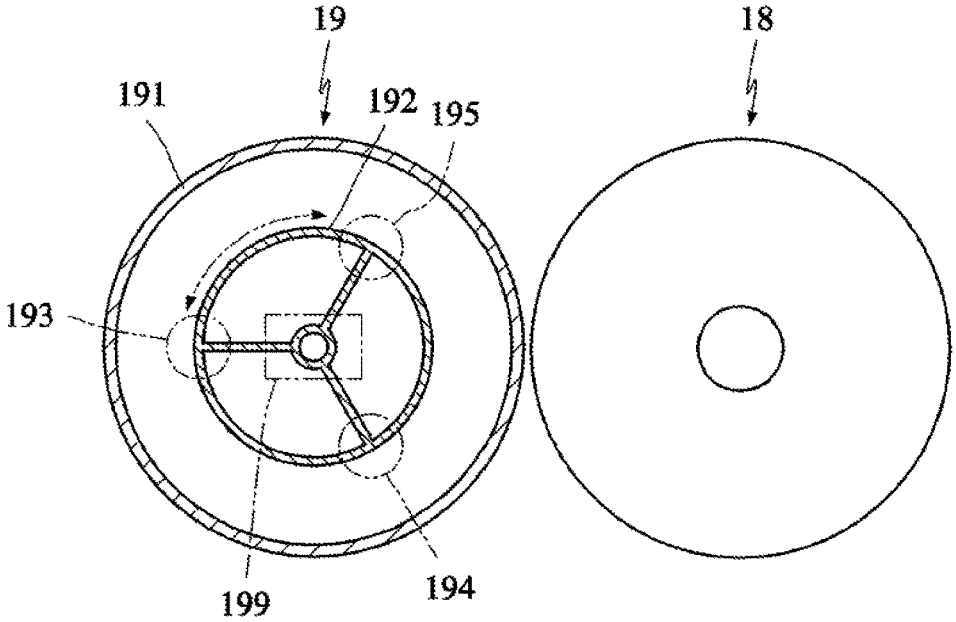
FIG. 3 is a schematic side view showing the heating roller and the pressure roller of FIG. 1 in a second position state.

FIGS. 2 and 3 respectively show the heating roller and the pressure roller of FIG. 1 in two position states. FIG. 4 is a schematic view showing a width direction of the heating roller. As shown in FIGS. 1 to 4, the heating roller 19 includes a roller cylinder 191, a base 192, first to third heaters 193, 194 and 195 and a driving mechanism 199.

The roller cylinder 191 is rotatably disposed on, for example, a body or a housing of the image forming apparatus 100. It is worth noting that the roller cylinder can also be implemented by a belt in conjunction with a heat-collecting metal sheet or a reflective sheet to provide the heat source for the roller cylinder. The base 192 may be rotatably disposed in the roller cylinder 191 and is rotatable relative to the roller cylinder 191. For example, the base 192 may be in the form of a cylindrical frame. The first to third heaters 193, 194 and 195 are, for example, heating lamps mounted on the base 192, and respectively have a first heating section 196, a second heating section 197 and a third heating section 198 (including two heating sub-sections) extending in directions substantially parallel (may have a skew angle ranging from 0 to 2, 3, 4 or 5 degrees) to an axial direction of the roller cylinder 191 (perpendicular to the paper direction of FIGS. 2 and 3), and the axial direction of the roller cylinder 191 is the horizontal direction of FIG. 4. In the first embodiment, when being axially or orthographically projected on the central axis of the roller cylinder 191, a second range R2 of the second heating section 197 covers and is larger than a first range R1 of the first heating section 196, the second range R2 ranges between two third ranges R3 of the third heating section 198, and the second range R2 is complementary to the two third ranges R3. In this embodiment, the two third ranges R3 are located on two sides of the second range R2. The driving mechanism 199 is composed of a motor and a gear set, for example. In this embodiment, the driving mechanism 199 is connected to the base 192 and rotates the base 192 to multiple position states, such as a first position state (FIG. 2) and a second position state (FIG. 3). The first to third heating conditions different from one another are provided according to the position states in conjunction with power-on and power-off states of the first heating section 196, the second heating section 197 and the third heating section 198. The first to third heaters 193, 194 and 195 have the same axial length, and this facilitates the power supply to the first to third heaters 193, 194 and 195. It is worth noting that in another example, the first to third ranges R1 to R3 may overlap slightly to avoid heat loss at the edges of heating sections. The first to third heating sections may be implemented by using resistor silks having high resistance or filaments. The sections other than the first to third heating sections are non-heating sections and have no effect of heating, but have an electroconductive effect and may be implemented by using the wires with the low resistance. For example, the third heater may be achieved by using a length of wire serially connected between two sections of the resistor silks or the filaments.

In this embodiment, the roller cylinder 191 provides the first to third heating conditions to cooperate with the pressure roller 18 to respectively fix the toner C onto the first to third sheets M1 to M3 having different widths. Thus, the first to third heating conditions relate to the widths of heating. For example, the first to third sheets M1 to M3 respectively have A5, A4 and A3 dimensions.

As shown in FIG. 2, in the first position state, the first heating section 196 is powered on to make the roller cylinder 191 provide the first heating condition, and the first heater 193 is closer to the pressure roller 18 than the second and third heaters 194 and 195, so that heating efficiency can be improved, and the waste of the heat source can be reduced. The length of the heating section of the first heater 193 is short, is suitable for printing sheets having smaller sizes, such as sheets having A5 sizes or smaller sizes, and the required electrical energy is low.

As shown in FIG. 3, in the second position state, the first heater 193 is further from the pressure roller 18 than the second and third heaters 194 and 195, and the second heating section 197 is powered on to make the roller cylinder 191 provide the second heating condition. The length of the heating section of the second heater 194 is moderate, and is suitable for printing sheets having medium sizes, such as the A4-sized sheets or sheets having the widths ranging between A4 and A5 sizes, and the required electrical energy is moderate. Also, in the second position state, the second heating section 197 and the third heating section 198 are powered on to make the roller cylinder 191 provide the third heating condition, and sheets having A3 sizes can be printed in the heating condition. In addition, in the second position state, a distance between the second heater 194 and the pressure roller 18 is equal to a distance between the third heater 195 and the pressure roller 18, that is, the connection line between the second heater 194 and the third heater 195 with respect to the center point of the pressure roller 18 and the heating roller 19 is symmetrical.

Thus, the image forming apparatus 100 provided by this embodiment includes the above-mentioned heating roller 19 and pressure roller 18 and a control processor 40 (see FIG. 1). The control processor 40 receives a printing signal PS so that the toner C is fixed onto one of the first to third sheets M1 to M3, and the control processor 40 controls the driving mechanism 199 to rotate the base 192 to the position states (the first position state and the second position state in this embodiment) according to width information of the printing signal PS.

In another implementation method, the image forming apparatus 100 includes the heating roller 19, the pressure roller 18, a width detector 50 and the control processor 40. The width detector 50 detects a width of one of the first to third sheets M1 to M3 to obtain a width signal WS. The control processor 40 receives width information of the printing signal PS and the width signal WS, so that the toner C is fixed onto one of the first to third sheets M1 to M3. The control processor 40 controls the driving mechanism 199 to rotate the base 192 to the position states (the first position state and the second position state in this embodiment) according to the width information. When the control processor 40 receives information on the malfunction of the first heater 193, the second heater 194 may be rotated to a position closest to the pressure roller 18, and the second heater 194 is used to temporarily replace the heating function of the first heater 193.

Figure 5:
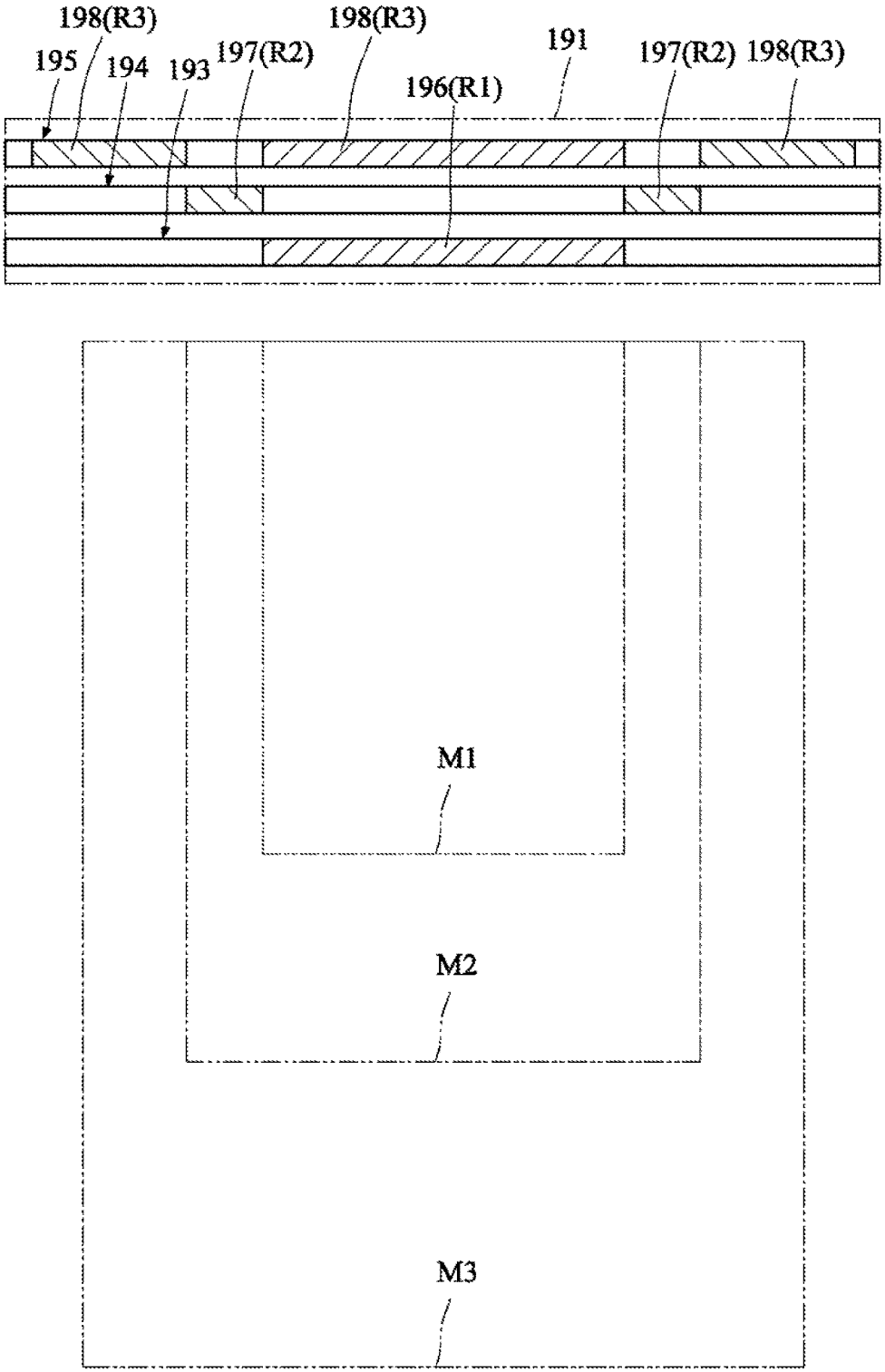
FIG. 5 is a schematic view showing sheets having different widths and the width direction of the heating roller according to a second embodiment of this disclosure.

FIG. 5 is a schematic view showing sheets having different widths and the width direction of the heating roller according to the second embodiment of this disclosure. As shown in FIG. 5, in the axial direction, a first range R1 of the first heating section 196 is located between two second ranges R2 of the second heating section 197, the two second ranges R2 are respectively located between three third ranges R3 of the third heating section 198, and the two second ranges R2 are complementary to the three third ranges R3. That is, the second and third ranges R2 and R3 do not overlap with each other but are complementary to one another. In addition, a middle one of the three third ranges R3 is overlapped with the first range R1 and has the same length as the first range R1. In this case, the two position states of FIGS. 2 and 3 are also applicable. In the first position state, the first heating section 196 is powered on (or the first heater 193 is powered on) to make the roller cylinder 191 provide the first heating condition. In the second position state, the first heating section 196 and the two second heating sections 197 are powered on (or the first heater 193 and the second heater 194 are powered on) to make the roller cylinder 191 provide the second heating condition. In the second position state, the two second heating sections 197 and the three third heating sections 198 are powered on (or the second heater 194 and the third heater 195 are powered on) to make the roller cylinder 191 provide the third heating condition. When the control processor 40 receives information on the malfunction of the first heater 193, the third heater 195 may be rotated to a position closest to the pressure roller 18, and the third heater 195 is used to temporarily replace the heating function of the first heater 193.

Figure 6:
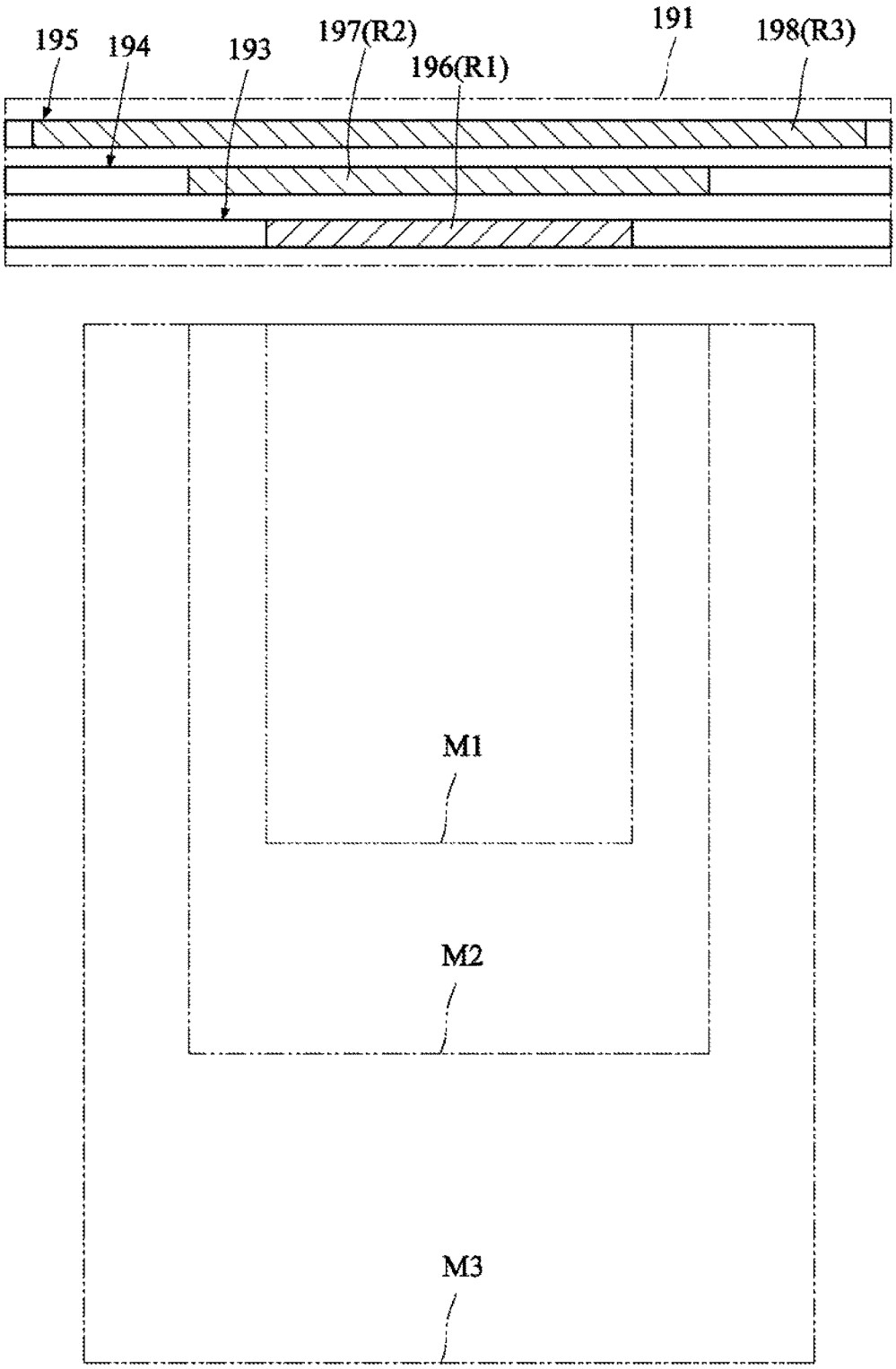
FIG. 6 is a schematic view showing sheets having different widths and the width direction of the heating roller according to a third embodiment of this disclosure.
Figure 7:
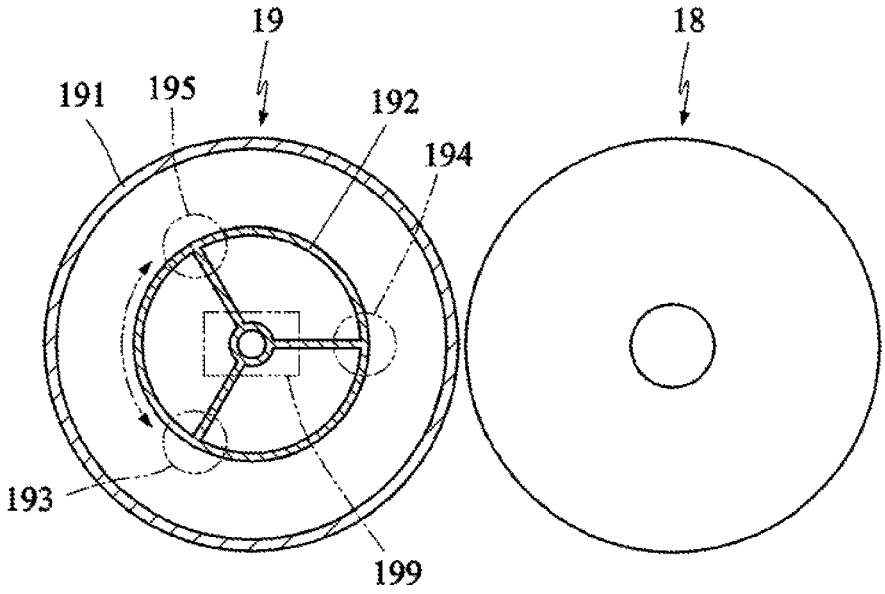
FIG. 7 is a schematic side view showing the heating roller and the pressure roller in the second position state according to the third embodiment of this disclosure.
Figure 8:
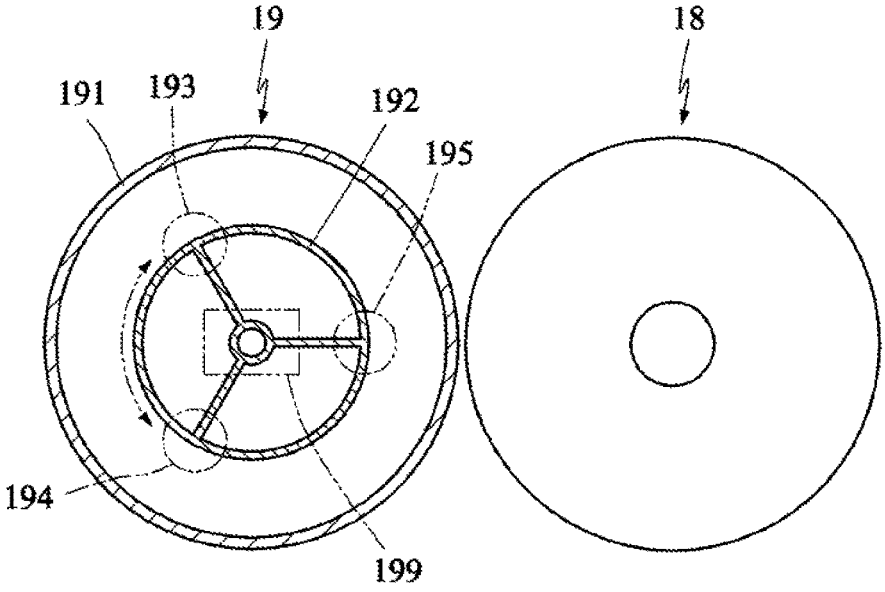
FIG. 8 is a schematic side view showing the heating roller and the pressure roller in the third position state according to the third embodiment of this disclosure.

FIG. 6 is a schematic view showing sheets having different widths and a width direction of a heating roller according to a third embodiment of this disclosure. FIGS. 7 and 8 are schematic side views showing the heating roller and the pressure roller in the second and third position states according to the third embodiment of this disclosure. As shown in FIGS. 6 to 8, in the axial direction, the third range R3 of the third heating section 198 covers and is larger than the second range R2 of the second heating section 197, and the second range R2 covers and is larger than the first range R1 of the first heating section 196. There are three types of position states in the third embodiment. In the first position state similar to the schematic side view of FIG. 2, the first heater 193 is closer to the pressure roller 18 than the second and third heaters 194 and 195, and the first heating section 196 (or the first heater 193) is powered on to make the roller cylinder 191 provide the first heating condition. In the second position state, as shown in FIG. 7, the second heater 194 is closer to the pressure roller 18 than the first and third heaters 193 and 195, and the second heating section 197 (or the second heater 194) is powered on to make the roller cylinder 191 provide the second heating condition. In the third position state, as shown in FIG. 8, the third heater 195 is closer to the pressure roller 18 than the first and second heaters 193 and 194, and the third heating section 198 (or the third heater 195) is powered on to make the roller cylinder 191 provide the third heating condition. That is, the heating actions of the first to third heaters are independent, and because a distance between each powered heater and the pressure roller 18 may be adjusted to a minimum, the power consumption is lower. In addition, when the first heater 193 fails, the base 192 may be rotated to temporarily provide alternative heating functions using the second heater 194. When the second heater 194 fails, the base 192 may be rotated to temporarily provide alternative heating functions using the third heater 195. It is worth noting that the heating rollers of the first to third embodiments are also applicable to the above-mentioned image forming apparatus 100, and the above-mentioned heating roller may also be applied to other occasions that require different heating conditions.

With the above-mentioned heating roller and image forming apparatus using the same, the print or copy procedures of more than three different sizes of sheets can be easily implemented, too-high temperature of the heating roller can be effectively avoided, the stable operational effect can be achieved, the waste of the heating power can be further effectively avoided, and the energy saving requirements of environmental protection can be achieved.

While this disclosure has been described by way of examples and in terms of preferred embodiments, it is to be understood that this disclosure is not limited thereto. To the contrary, it is intended to cover various modifications. Therefore, the scope of the appended claims should be accorded the broadest interpretation so as to encompass all such modifications.

What is claimed is:

1. A heating roller, comprising:

a roller cylinder rotatably disposed;

a base rotatably disposed in the roller cylinder;

first to third heaters, which are mounted on the base, and respectively have a first heating section, a second heating section and a third heating section extending in directions substantially parallel to an axial direction of the roller cylinder; and a driving mechanism, which is connected to the base and rotates the base to multiple position states, wherein first to third heating conditions different from one another are provided according to the position states in conjunction with power-on and power-off states of the first heating section, the second heating section and the third heating section, wherein in the axial direction, a second range of the second heating section covers and is larger than a first range of the first heating section, the second range ranges between two third ranges of the third heating section, and the second range is complementary to the two third ranges.

2. The heating roller according to claim 1, wherein the roller cylinder provides the first to third heating conditions to cooperate with a pressure roller to fix toner onto first to third sheets having different widths.

3. The heating roller according to claim 2, wherein in a first position state of the position states, the first heating section is powered on to make the roller cylinder provide the first heating condition; in a second position state of the position states, the second heating section is powered on to make the roller cylinder provide the second heating condition; and in the second position state, the second heating section and the third heating section are powered on to make the roller cylinder provide the third heating condition.

4. The heating roller according to claim 3, wherein: in the first position state, the first heater is closer to the pressure roller than the second and third heaters; and in the second position state, the first heater is further from the pressure roller than the second and third heaters; and in the second position state, a distance between the second heater and the pressure roller is equal to a distance between the third heater and the pressure roller.

5. The heating roller according to claim 2, wherein the first, second and third sheets respectively have A5, A4 and A3 dimensions.

6. An image forming apparatus, comprising:

the heating roller and the pressure roller according to claim 2; and a control processor, which receives a printing signal so that the toner is fixed onto one of the first to third sheets, wherein the control processor controls the driving mechanism to rotate the base to the position states according to width information of the printing signal.

7. An image forming apparatus, comprising:

the heating roller and the pressure roller according to claim 2;

a width detector detecting a width of one of the first to third sheets to obtain a width signal; and a control processor, which receives a printing signal and the width signal so that the toner is fixed onto one of the first to third sheets, wherein the control processor controls the driving mechanism to rotate the base to the position states according to width information of the width signal.

8. The heating roller according to claim 1, wherein the first to third heaters have the same axial length.

9. A heating roller, comprising:

a roller cylinder rotatably disposed;

a base rotatably disposed in the roller cylinder;

first to third heaters, which are mounted on the base, and respectively have a first heating section, a second heating section and a third heating section extending in directions substantially parallel to an axial direction of the roller cylinder; and a driving mechanism, which is connected to the base and rotates the base to multiple position states, wherein first to third heating conditions different from one another are provided according to the position states in conjunction with power-on and power-off states of the first heating section, the second heating section and the third heating section, wherein in the axial direction, a first range of the first heating section is located between two second ranges of the second heating section, the two second ranges are respectively located between three third ranges of the third heating section, the two second ranges are complementary to the three third ranges, and a middle one of the three third ranges is overlapped with the first range.

10. The heating roller according to claim 9, wherein the roller cylinder provides the first to third heating conditions to cooperate with a pressure roller to fix toner onto first to third sheets having different widths.

11. The heating roller according to claim 10, wherein in a first position state of the position states, the first heating section is powered on to make the roller cylinder provide the first heating condition; in a second position state of the position states, the first heating section and the second heating section are powered on to make the roller cylinder provide the second heating condition; and in the second position state, the second heating section and the third heating section are powered on to make the roller cylinder provide the third heating condition.

12. The heating roller according to claim 10, wherein: in a first position state of the position states, the first heater is closer to the pressure roller than the second and third heaters; and in a second position state of the position states, the first heater is further from the pressure roller than the second and third heaters, and a distance between the second heater and the pressure roller is equal to a distance between the third heater and the pressure roller.

13. The heating roller according to claim 10, wherein the first, second and third sheets respectively have A5, A4 and A3 dimensions.

14. An image forming apparatus, comprising:

the heating roller and the pressure roller according to claim 10; and a control processor, which receives a printing signal so that the toner is fixed onto one of the first to third sheets, wherein the control processor controls the driving mechanism to rotate the base to the position states according to width information of the printing signal.

15. An image forming apparatus, comprising:

the heating roller and the pressure roller according to claim 10;

a width detector detecting a width of one of the first to third sheets to obtain a width signal; and a control processor, which receives a printing signal and the width signal so that the toner is fixed onto one of the first to third sheets, wherein the control processor controls the driving mechanism to rotate the base to the position states according to width information of the width signal.

16. The heating roller according to claim 9, wherein the first to third heaters have the same axial length.

* * * * *